US007713076B2

(12) United States Patent
Arts et al.

(10) Patent No.: US 7,713,076 B2
(45) Date of Patent: May 11, 2010

(54) FLOATING CONNECTOR FOR MICROWAVE SURGICAL DEVICE

(75) Inventors: Gene H. Arts, Berthoud, CO (US); Christopher A. Deborski, Denver, CO (US)

(73) Assignee: Vivant Medical, Inc., Boulder, CO (US)

( * ) Notice: Subject to any disclaimer, the term of this patent is extended or adjusted under 35 U.S.C. 154(b) by 0 days.

(21) Appl. No.: 12/273,411

(22) Filed: Nov. 18, 2008

(65) Prior Publication Data

US 2009/0137145 A1 May 28, 2009

Related U.S. Application Data

(60) Provisional application No. 60/990,341, filed on Nov. 27, 2007.

(51) Int. Cl.
*H01R 13/64* (2006.01)

(52) U.S. Cl. ..... 439/248; 439/63

(58) Field of Classification Search ..... 439/63, 439/246–249, 578–585
See application file for complete search history.

(56) References Cited

U.S. PATENT DOCUMENTS 3,590,377 A * 6/1971 Sorger ..... 324/758
4,355,857 A * 10/1982 Hayward ..... 439/578
4,553,436 A 11/1985 Hansson
4,632,435 A 12/1986 Polyak
4,718,864 A 1/1988 Flanagan
5,077,522 A * 12/1991 Lahitte et al. ..... 324/754
5,211,570 A 5/1993 Bitney
5,312,329 A 5/1994 Beaty et al.
5,605,150 A 2/1997 Radons et al.
5,776,130 A 7/1998 Buysse et al.
5,931,688 A 8/1999 Hasz et al.
5,944,548 A * 8/1999 Saito ..... 439/248
6,039,733 A 3/2000 Buysse et al.
6,093,028 A 7/2000 Yang
6,174,309 B1 1/2001 Wrublewski et al.
6,176,856 B1 1/2001 Jandak et al.
6,224,421 B1 5/2001 Maturo, Jr.
6,259,074 B1 7/2001 Brunner et al.
6,347,950 B1 2/2002 Yokoyama et al.
6,350,262 B1 2/2002 Ashley
6,379,071 B1 4/2002 Sorvino (Continued)

FOREIGN PATENT DOCUMENTS

DE 390937 3/1924

(Continued)

OTHER PUBLICATIONS

U.S. Appl. No. 08/483,742, filed Jun. 7, 1995.

(Continued)

*Primary Examiner*—Khiem Nguyen

(57) ABSTRACT

A floating connector adapted for use with microwave surgical instruments is presented. The disclosure provides for the use of cost-effective and readily available non-floating connectors in a floating housing which can compensate for dimensional variations and misalignments between the connectors. Multiple connectors of varying types can therefore be used within a single support housing without requiring the costly precision manufacturing processes normally associated with such multiple connector assemblies. The floating connector is suitable for use with electrical connections as well as fluidic connections.

11 Claims, 8 Drawing Sheets

U.S. PATENT DOCUMENTS

| | | | | |
|---|---|---|---|---|
| 6,494,501 | B2 | 12/2002 | Gotoh | |
| 6,506,081 | B2 | 1/2003 | Blanchfield et al. | |
| 6,544,069 | B1 | 4/2003 | Enriquez et al. | |
| 6,981,889 | B1 * | 1/2006 | Grothen et al. | 439/374 |
| 7,041,102 | B2 | 5/2006 | Truckai et al. | |
| 7,090,521 | B2 | 8/2006 | Nishio et al. | |
| 7,344,268 | B2 | 3/2008 | Jigamian | |
| 2005/0149010 | A1 | 7/2005 | Turovskiy et al. | |
| 2009/0021002 | A1 | 1/2009 | DeCarlo | |
| 2009/0061681 | A1 | 3/2009 | McMunigal et al. | |
| 2009/0130897 | A1 | 5/2009 | McMunigal et al. | |

FOREIGN PATENT DOCUMENTS

| | | |
|---|---|---|
| DE | 1099658 | 2/1961 |
| DE | 1139927 | 11/1962 |
| DE | 1149832 | 6/1963 |
| DE | 1439302 | 1/1969 |
| DE | 2439587 | 2/1975 |
| DE | 2455174 | 5/1975 |
| DE | 2407559 | 8/1975 |
| DE | 2415263 | 10/1975 |
| DE | 2429021 | 1/1976 |
| DE | 2460481 | 6/1976 |
| DE | 2602517 | 7/1976 |
| DE | 2504280 | 8/1976 |
| DE | 2627679 | 1/1977 |
| DE | 2540968 | 3/1977 |
| DE | 2820908 | 11/1978 |
| DE | 2803275 | 8/1979 |
| DE | 2823291 | 11/1979 |
| DE | 2946728 | 5/1981 |
| DE | 3143421 | 5/1982 |
| DE | 3045996 | 7/1982 |
| DE | 3120102 | 12/1982 |
| DE | 3510586 | 10/1986 |
| DE | 3604823 | 8/1987 |
| DE | 8712328 | 3/1988 |
| DE | 3711511 | 6/1988 |
| DE | 3904558 | 8/1990 |
| DE | 3942998 | 7/1991 |
| DE | 4238263 | 5/1993 |
| DE | 4303882 | 8/1994 |
| DE | 4339049 | 5/1995 |
| DE | 29616210 | 1/1997 |
| DE | 19608716 | 4/1997 |
| DE | 19751106 | 5/1998 |
| DE | 19717411 | 11/1998 |
| DE | 19751108 | 5/1999 |
| DE | 19801173 | 7/1999 |
| DE | 19848540 | 5/2000 |
| DE | 10224154 | 12/2003 |
| DE | 10328514 | 3/2005 |
| DE | 102004022206 | 12/2005 |
| DE | 202005015147 | 3/2006 |
| EP | 0 246 350 | 11/1987 |
| EP | 0 481 685 | 4/1992 |
| EP | 0 521 264 | 1/1993 |
| EP | 0 541 930 | 5/1993 |
| EP | 0 556 705 | 8/1993 |
| EP | 0 558 429 | 9/1993 |
| EP | 0 572 131 | 12/1993 |
| EP | 0 836 868 | 4/1998 |
| EP | 1 159 926 | 5/2001 |
| EP | 1732178 | 12/2006 |
| FR | 179607 | 11/1906 |
| FR | 1 275 415 | 9/1960 |
| FR | 1 347 865 | 11/1963 |
| FR | 2 276 027 | 6/1974 |
| FR | 2 235 669 | 1/1975 |
| FR | 2 313 708 | 12/1976 |
| FR | 2 502 935 | 10/1982 |
| FR | 2 517 953 | 6/1983 |
| FR | 2 573 301 | 11/1984 |
| FR | 2 862 813 | 5/2005 |
| FR | 2 864 439 | 7/2005 |
| GB | 2128038 | 4/1984 |
| JP | 5-5106 | 1/1993 |
| JP | 05-40112 | 2/1993 |
| JP | 06343644 | 12/1994 |
| JP | 07265328 | 10/1995 |
| JP | 08056955 | 3/1996 |
| JP | 08252263 | 10/1996 |
| JP | 09010223 | 1/1997 |
| JP | 11244298 | 9/1999 |
| JP | 2000342599 | 12/2000 |
| JP | 2000350732 | 12/2000 |
| JP | 2001008944 | 1/2001 |
| JP | 2001029356 | 2/2001 |
| JP | 2001128990 | 5/2001 |
| SU | 166452 | 11/1964 |
| SU | 401367 | 11/1974 |
| SU | 727201 | 4/1980 |
| WO | 97/10764 | 3/1997 |

OTHER PUBLICATIONS

U.S. Appl. No. 08/136,098, filed Oct. 14, 1993.
U.S. Appl. No. 09/195,118, filed Nov. 18, 1998.
U.S. Appl. No. 10/244,346, filed Sep. 16, 2002.
U.S. Appl. No. 11/053,987, filed Feb. 8, 2005.
U.S. Appl. No. 12/023,606, filed Jan. 31, 2008.
U.S. Appl. No. 12/129,482, filed May 29, 2008.
U.S. Appl. No. 12/135,425, filed Jun. 9, 2008.
U.S. Appl. No. 12/135,690, filed Jun. 9, 2008.
U.S. Appl. No. 12/147,093, filed Jun. 26, 2008.
U.S. Appl. No. 12/181,504, filed Jul. 29, 2008.
U.S. Appl. No. 12/184,556, filed Aug. 1, 2008.
U.S. Appl. No. 12/194,254, filed Aug. 19, 2008.
U.S. Appl. No. 12/197,601, filed Aug. 25, 2008.
U.S. Appl. No. 12/197,405, filed Aug. 25, 2008.
U.S. Appl. No. 12/197,473, filed Aug. 25, 2008.
U.S. Appl. No. 12/199,935, filed Aug. 28, 2008.
U.S. Appl. No. 12/203,474, filed Sep. 3, 2008.
U.S. Appl. No. 12/236,686, filed Sep. 24, 2008.
U.S. Appl. No. 12/244,850, filed Oct. 3, 2008.
U.S. Appl. No. 12/250,110, filed Oct. 13, 2008.
U.S. Appl. No. 12/250,171, filed Oct. 13, 2008.
U.S. Appl. No. 12/253,457, filed Oct. 17, 2008.
U.S. Appl. No. 12/277,951, filed Nov. 25, 2008.
U.S. Appl. No. 12/350,292, filed Jan. 8, 2009.
U.S. Appl. No. 12/351,633, filed Jan. 9, 2009.
U.S. Appl. No. 12/353,623, filed Jan. 14, 2009.
U.S. Appl. No. 12/353,617, filed Jan. 14, 2009.
U.S. Appl. No. 12/356,650, filed Jan. 21, 2009.
U.S. Appl. No. 12/366,298, filed Feb. 5, 2009.
U.S. Appl. No. 12/389,906, filed Feb. 20, 2009.
U.S. Appl. No. 12/389,915, filed Feb. 20, 2009.
U.S. Appl. No. 12/395,034, filed Feb. 27, 2009.
U.S. Appl. No. 12/399,222, filed Mar. 6, 2009.
U.S. Appl. No. 12/401,268, filed Mar. 10, 2009.
U.S. Appl. No. 12/413,011, filed Mar. 27, 2009.
U.S. Appl. No. 12/413,023, filed Mar. 27, 2009.
U.S. Appl. No. 12/416,583, filed Apr. 1, 2009.
U.S. Appl. No. 12/419,395, filed Apr. 7, 2009.
U.S. Appl. No. 12/423,609, filed Apr. 14, 2009.
U.S. Appl. No. 12/434,903, filed May 4, 2009.
U.S. Appl. No. 12/436,237, filed May 6, 2009.
U.S. Appl. No. 12/436,239, filed May 6, 2009.
U.S. Appl. No. 12/436,231, filed May 6, 2009.
U.S. Appl. No. 12/472,831, filed May 27, 2009.
U.S. Appl. No. 12/475,082, filed May 29, 2009.
U.S. Appl. No. 12/476,960, filed Jun. 2, 2009.

Alexander et al., "Magnetic Resonance Image-Directed Stereotactic Neurosurgery: Use of Image Fusion with Computerized Tomography to Enhance Spatial Accuracy" Journal Neurosurgery, 83 (1995), pp. 271-276.
Anderson et al., "A Numerical Study of Rapid Heating for High Temperature Radio Frequency Hyperthermia" International Journal of Bio-Medical Computing, 35 (1994), pp. 297-307.
Anonymous. (1999) Auto Suture MIBB Site Marker: Single Use Clip Applier, United States Surgical (Product instructions), 2 pages.
Anonymous. (2001) Disposable Chiba Biopsy Needles and Trays, Biopsy and Special Purpose Needles Cook Diagnostic and Interventional Products Catalog (products list), 4 pages.
Anonymous. (1987) Homer Mammalok™ Breast Lesion Needle/ Wire Localizer, Namic ® Angiographic Systems Division, Glens Falls, New York, (Hospital products price list), 4 pages.
Anonymous. (1999) MIBB Site Marker, United States Surgical (Sales brochure), 4 pages.
Anonymous. Blunt Tubes with Finished Ends. Pointed Cannula, Popper & Sons Biomedical Instrument Division, (Products Price List), one page, Jul. 19, 2000.
Anonymous. Ground Cannulae, ISPG, New Milford, CT, (Advertisement) one page, Jul. 19, 2000.
B. Levy M.D. et al., "Update on Hysterectomy New Technologies and Techniques" OBG Management, Feb. 2003.
B. Levy M.D., "Use of a New Vessel Ligation Device During Vaginal Hysterectomy" FIGO 2000, Washington, D.C.
B. Levy M.D. et al., "Randomized Trial of Suture Versus Electrosurgical Bipolar Vessel Sealing in Vaginal Hysterectomy" Obstetrics & Gynecology, vol. 102, No. 1, Jul. 2003.
B. F. Mullan et al., (May 1999) "Lung Nodules: Improved Wire for CT-Guided Localization," Radiology 211:561-565.
B. T. Heniford M.D. et al., "Initial Research and Clinical Results with an Electrothermal Bipolar Vessel Sealer" Oct. 1999.
Bergdahl et al., "Studies on Coagulation and the Development of an Automatic Computerized Bipolar Coagulator" Journal of Neurosurgery 75:1 (Jul., 1991), pp. 148-151.
Bulletin of the American Physical Society, vol. 47, No. 5, Aug. 2002, p. 41.
C. F. Gottlieb et al., "Interstitial Microwave Hyperthermia Applicators having Submillimetre Diameters", Int. J. Hyperthermia, vol. 6, No. 3, pp. 707-714, 1990.
C. H. Dumey et al., "Antennas for Medical Applications", Antenna Handbook: Theory Application and Design, p. 24-40, Van Nostrand Reinhold, 1988 New York, V.T. Lo, S.W. Lee.
Carbonell et al., "Comparison of the Gyrus PlasmaKinetic Sealer and the Valleylab LigaSure™ Device in the Hemostasis of Small, Medium, and Large-Sized Arteries" Carolinas Laparoscopic and Advanced Surgery Program, Carolinas Medical Center, Charlotte, NC 2003.
Carus et al., "Initial Experience With the LigaSurerm™ Vessel Sealing System in Abdominal Surgery" Innovations That Work, Jun. 2002.
Chicharo et al., "A Sliding Goertzel Algorithm" Aug. 1996 DOS pp. 283-297 Signal Processing, Elsevier Science Publishers B.V. Amsterdam, NL, vol. 52, No. 3.
Chou, C.K., (1995) "Radiofrequency Hyperthermia in Cancer Therapy," Chapter 941n Biologic Effects of Nonionizing Electromagnetic Fields, CRC Press, Inc., pp. 1424-1428.
Chung et al., "Clinical Experience of Sutureless Closed Hemorrhoidectomy with LigaSure™ " Diseases of the Colon & Rectum, vol. 46, No. 1, Jan. 2003.
Cosman et al., "Radiofrequency Lesion Generation and its Effect on Tissue Impedence", Applied Neurophysiology, 51:230-242, 1988.
Cosman et al., Theoretical Aspects of "Radiofrequency Lesions in the Dorsal Root Entry Zone" Neurosurgery 15:(1984), pp. 945-950.
Cosman et al., "Methods of Making Nervous System Lesions" in William RH,. Rengachary SS (eds): Neurosurgery, New York: McGraw-Hill, vol. 111, (1984), pp. 2490-2499.
Crawford et al., "Use of the LigaSure™ Vessel Sealing System in Urologic Cancer Surger" Grand Rounds in Urology 1999, vol. 1, Issue 4, pp. 10-17.
Dulemba et al., "Use of a Bipolar Electrothermal Vessel Sealer in Laparoscopically Assisted Vaginal Hysterectomy" Sales/Product Literature; Jan. 2004.
E. David Crawford, "Evaluation of a New Vessel Sealing Device in Urologic Cancer Surgery" Sales/Product Literature 2000.
E. David Crawford, "Use of a Novel Vessel Sealing Technology in Management of the Dorsal Veinous Complex" Sales/Product Literature 2000.
Esterline Product Literature, "Light Key: Visualize a Virtual Keyboard. One With no. Moving Parts", 4 pages.
Esterline, "Light Key Projection Keyboard" 2004 Advanced Input Systems, located at: <http://www.advancedinput.com/lightkey> last visited on Feb. 10, 2005.
Geddes et al., "The Measurement of Physiologic Events by Electrical lmpedence" Am. J. MI, Jan. Mar. 1964, pp. 16-27.
Goldberg et al., "Image-guided Radiofrequency Tumor Ablation: Challenges and Opportunities - Part I", (2001) J Vasc. lnterv. Radio!, vol. 12, pp. 1021-1032.
Goldberg et al., "Tissue Ablation with Radiofrequency: Effect of Probe Size, Gauge, Duration, and Temperature on Lesion Volume" Acad Radio (1995) vol. 2, No. 5, pp. 399-404.
Heniford et al., "Initial Results with an Electrothermal Bipolar Vessel Sealer" Surgical Endoscopy (2001) 15:799801.
Herman at al., "Laparoscopic Intestinal Resection With the LigaSure™ Vessel Sealing System: A Case Report" Innovations That Work, Feb. 2002.
Ian D. McRury et al., The Effect of Ablation Sequence and Duration on Lesion Shape Using Rapidly Pulsed Radiofrequency Energy Through Electrodes, Feb. 2000, Springer Netherlands, vol. 4; No. 1, pp. 307-320.
Johnson et al., "Evaluation of a Bipolar Electrothermal Vessel Sealing Device in Hemorrhoidectomy" Sales/Product Literature, Jan. 2004.
Jarrett et al., "Use of the LigaSure™ Vessel Sealing System for Peri-Hilar Vessels in Laparoscopic Nephrectomy" Sales/Product Literature 2000.
Johnson, "Evaluation of the LigaSure™ Vessel Sealing System in Hemorrhoidectormy" American College of Surgeons (ACS) Clinic La Congress Poster (2000).
Johnson, "Use of the LigaSure™ Vessel Sealing System in Bloodless Hemorrhoidectomy" Innovations That Work, Mar. 2000.
Joseph G. Andriole M.D. et al., "Biopsy Needle Characteristics Assessed in the Laboratory", Radiology 148: 659662, Sep. 1983.
Joseph Ortenberg, " LigaSure™ System Used in Laparoscopic 1st and 2nd Stage Orchiopexy" Innovations That Work, Nov. 2002.
K. Ogata, Modem Control Engineering, Prentice-Hall, Englewood Cliffs, N.J., 1970.
Kennedy et al., "High-burst-strength, feedback-controlled bipolar vessel sealing" Surgical Endoscopy (1998) 12: 876-878.
Kopans, D.B. et al., (Nov. 1985) "Spring Hookwire Breast Lesion Localizer: Use with Rigid-Compression. Mammographic Systems," Radiology 157(2):537-538.
Koyle et al., "Laparoscopic Palomo Varicocele Ligation in Children and Adolescents" Pediatric Endosurgery & Innovative Techniques, vol. 6, No. 1, 2002.
LigaSure™ Vessel Sealing System, the Seal ofConfidence in General , Gynecologic, Urologic, and Laparaoscopic Surgery, Sales/Product Literature, Jan. 2004.
Livraghi et al., (1995) "Saline-enhanced RF Tissue Ablation in the Treatment of Liver Metastases", Radiology, pp. 205-210.
Lyndon B. Johnson Space Center, Houston, Texas, "Compact Directional Microwave Antenna for Localized Heating," NASA Tech Briefs, Mar. 2008.
M. A. Astrahan, "A Localized Current Field Hyperthermia System for Use with 192-iridium Interstitial Implants" Medical Physics. 9(3), May/Jun. 1982.
Magdy F. Iskander et al., "Design Optimization of Interstitial Antennas", IEEE Transactions on Biomedical Engineering, vol. 36, No. 2, Feb. 1989, pp. 238-246.
McGahan et al., (1995) "Percutaneous Ultrasound-guided Radiofrequency Electrocautery Ablation of Prostate Tissue in Dogs", Acad Radiol, vol. 2, No. 1: pp. 61-65.

McLellan et al., "Vessel Sealing for Hemostasis During Pelvic Surgery" Int'l Federation of Gynecology and Obstetrics Figo World Congress 2000, Washington, DC.
MDTECH product literature (Mar. 2000) I'D Wire: product description, 1 page.
MDTECH product literature (Dec. 1999) "FlexStrand": product description, 1 page.
Medtrex Brochure "The O.R. Pro 300" 1 page, Sep. 1998.
Michael Choti, "Abdominoperineal Resection with the LigaSure™ Vessel Sealing System and LigaSure™ Atlas 20 cm Open Instrument" Innovations That Work, Jun. 2003.
Muller et al., "Extended Left Hemicolectomy Using the LigaSure™ Vessel Sealing System" Innovations That Work. LJ, Sep. 1999.
Murakami, R. et al., (1995). "Treatment of Hepatocellular Carcinoma: Value of Percutaneous Microwave Coagulation," American Journal of Radiology (AJR) 164:1159-1164.
Ni Wei et al., "A Signal Processing Method for the Coriolis Mass Flowmeter Based on a Normalized . . . " Journal of Applied Sciences. Yingyong Kexue Xuebao, Shangha CN, vol. 23, No. 2:(2005.03); pp•160-184.
Ogden, "Goertzel Alternative to the Fourier Transform" Jun. 1993 pp. 485-487 Electronics World; Reed Business Publishing, Sutton, Surrey, BG, vol. 99, No. 9, 1687.
Olsson M.D. et al., "Radical Cystectomy in Females" Current Surgical Techniques in Urology, vol. 14, Issue 3, 2001.
Organ, L W., "Electrophysiologic Principles of Radiofrequency Lesion Making" Appl. Neurophysiol, vol. 39: pp. 69-76 (1976/77).
P.R. Stauffer et al., "Interstitial Heating Technologies", Thermoradiotheray and Thermochemotherapy (1995) vol. I, Biology, Physiology, Physics, pp. 279-320.
Palazzo et al., "Randomized clinical trial of LigaSure™ versus open haemorrhoidectomy" British Journal of Surgery 2002,89,154-157 "Innovations in Electrosurgery" Sales/Product Literature; Dec. 31, 2000.
Paul G. Horgan, "A Novel Technique for Parenchymal Division During Hepatectomy" The American Journal of Surgery, vol. 181, No. 3, Oapril 2001, pp. 236-237.
Peterson et al., "Comparison of Healing Process Following Ligation with Sutures and Bipolar Vessel Sealing" Surgical Technology International (2001).
R. Gennari et al., (Jun. 2000) "Use of Technetium-99m-Labeled Colloid Albumin for Preoperative and Intraoperative Localization of Non palpable Breast Lesions," American College of Surgeons. 190(6):692-699.
Valleylab Brochure, "Reducing Needlestick Injuries in the Operating Room" 1 page, Mar. 2001.
Reidenbach, (1995) "First Experimental Results with Special Applicators for High-Frequency Interstitial-Thermotherapy", Society Minimally Invasive Therapy, 4(Suppl 1):40 (Abstr).
Richard Wolf Medical Instruments Corp. Brochure, "Kleppinger Bipolar Forceps & Bipolar Generator" 3 pages, Jan. 1989.
Rothenberg et al., "Use of the LigaSure™ Vessel Sealing System in Minimally Invasive Surgery in Children" Int'l, Pediatric Endosurgery Group (I PEG) 2000.
Sayfan et al., "Sutureless Closed Hemorrhoidectomy: A New Technique" Annals of Surgery, voI. 234, No. 1, Jul. 2001, pp. 21-24.
Sengupta et al., "Use of a Computer-Controlled Bipolar Diathermy System in Radical Prostatectomies and Other Open Urological Surgery" ANZ Journal of Surgery (2001)71.9 pp. 538-540.
Sigel et al., "The Mechanism of Blood Vessel Closure by High Frequency Electrocoagulation" Surgery Gynecology & Obstetrics, Oct. 1965 pp. 823-831.
Solbiati et al.; (2001) "Percutaneous Radio-frequency Ablation of Hepatic Metastases from Colorectal Cancer: Long-term Results in 117 Patients", Radiology, vol. 221, pp. 159-166.
Strasberg et al., "Use of a Bipolar Vassel-Sealing Device for Parenchymal Transection During Liver Surgery" Journal of Gastrointestinal Surgery, vol. 6, No. 4, Jul./Aug. 2002 pp. 569-574.
Stuart W. Young, Nuclear Magnetic Resonance Imaging--Basic Principles, Raven Press, New York, 1984.
Sugita et al., "Bipolar Coagulator with Automatic Thermocontrol" J. Neurosurg., vol. 41, Dec. 1944, pp. 777-779.
Sylvain Labonte et al., "Monopole Antennas for Microwave Catheter Ablation", IEEE Trans. On Microwave Theory and Techniques, vol. 44, No. 10, pp. 1832-1840, Oct. 1995.
T. Matsukawa et al., "Percutaneous Microwave Coagulation Therapy in Liver Tumors", Acta Radiologica, vol. 38, pp. 410-415, 1997.
T. Seki et al., (1994) "Ultrasonically Guided Percutaneous Microwave Coagulation Therapy for Small Hepatocellular Carcinoma," Cancer 74(3):817.825.
S. Humphries Jr. et al., "Finite.Element Codes to Model Electrical Heating and Non•Linear Thermal Transport in Biological Media", Proc. ASME HTD-355, 131 (1997).
Urologix, Inc.-Medical Professionals: Targis™ Technology (Date Unknown). "Overcoming the Challenge" located at: <http://www.urologix.com!medicaUtechnology.html > last visited on Apr. 27, 2001, 3 pages.
Urrutia et al., (1988). "Retractable-Barb Needle for Breast Lesion Localization: Use in 60 Cases," Radiology 169(3):845-847.
Valleylab Brochure, "Valleylab Electroshield Monitoring System" 2 pages, Nov. 1995.
ValleyLab Brochure, "Electosurgery: A Historical Overview", Innovations in Electrosurgery, 1999.
Vallfors et al., "Automatically Controlled Bipolar Electrocoagulation-'COA-COMP'" Neurosurgical Review 7:2-3 (1984) pp. 187-190.
W. Scott Helton, "LigaSure™ Vessel Sealing System: Revolutionary Hemostasis Product for General Surgery" Sales/Product Literature 1999.
Wald et al., "Accidental Burns", JAMA, Aug. 16, 1971, vol. 217, No. 7, pp. 916-921.
Walt Boyles, "Instrumentation Reference Book", 2002, Butterworth-Heinemann, pp. 262-264.
European Search Report EP 03721482 dated Feb. 6, 2006.
European Search Report EP 04009964 dated Jul. 28, 2004.
European Search Report EP 04013772 dated Apr. 11, 2005.
European Search Report EP 04015980 dated Nov. 3, 2004.
European Search Report EP 04015981.6 dated Oct. 25, 2004.
European Search Report EP 04027314 dated Mar. 31, 2005.
European Search Report EP 04027479 dated Mar. 17, 2005.
European Search Report EP 04027705 dated Feb. 10, 2005.
European Search Report EP 04710258 dated Oct. 15, 2004.
European Search Report EP 04752343.6 dated Jul. 31, 2007.
European Search Report EP 05002027.0 dated May 12, 2005.
European Search Report EP 05002769.7 dated Jun. 19, 2006.
European Search Report EP 05013463.4 dated Oct. 7, 2005.
European Search Report EP 05013895 dated Oct. 21, 2005.
European Search Report EP 05014156.3 dated Jan. 4, 2006.
European Search Report EP 05016399 dated Jan. 13, 2006.
European Search Report EP 05017281 dated Nov. 24, 2005.
European Search Report EP 05019130.3 dated Oct. 27, 2005.
European Search Report EP 05019882 dated Feb. 16, 2006.
European Search Report EP 05020665.5 dated Feb. 27, 2006.
European Search Report EP 05020666.3 dated Feb. 27, 2006.
European Search Report EP 05021025.1 dated Mar. 13, 2006.
European Search Report EP 05021197.8 dated Feb. 20, 2006.
European Search Report EP 05021777 dated Feb. 23, 2006.
European Search Report EP 05021779.3 dated Feb. 2, 2006.
European Search Report EP 05021780.1 dated Feb. 23, 2006.
European Search Report EP 05021935 dated Jan. 27, 2006.
European Search Report EP 05021936.9 dated Feb. 6, 2006.
European Search Report EP 05021937.7 dated Jan. 23, 2006.
European Search Report EP 05021939 dated Jan. 27, 2006.
European Search Report EP 05021944.3 dated Jan. 25, 2006.
European Search Report EP 05022350.2 dated Jan. 30, 2006.
European Search Report EP 05023017.6 dated Feb. 24, 2006.
European Search Report EP 05025423.4 dated Jan. 19, 2007.
European Search Report EP 05025424 dated Jan. 30, 2007.
European Search Report EP 06000708.5 dated May 15, 2006.
European Search Report EP 06002279.5 dated Mar. 30, 2006.
European Search Report EP 06005185.1 dated May 10, 2006.
European Search Report EP 06005540 dated Sep. 24, 2007.
European Search Report EP 06006717.0 dated Aug. 11, 2006.
European Search Report EP 06006961 dated Oct. 22, 2007.
European Search Report EP 06006963 dated Jul. 25, 2006.

European Search Report EP 06008779.8 dated Jul. 13, 2006.
European Search Report EP 06009435 dated Jul. 13, 2006.
European Search Report EP 06010499.9 dated Jan. 29, 2008.
European Search Report EP 06014461.5 dated Oct. 31, 2006.
European Search Report EP 06018206.0 dated Oct. 20, 2006.
European Search Report EP 06019768 dated Jan. 17, 2007.
European Search Report EP 06020574.7 dated Oct. 2, 2007.
European Search Report EP 06020583.8 dated Feb. 7, 2007.
European Search Report EP 06020584.6 dated Feb. 1, 2007.
European Search Report EP 06020756.0 dated Feb. 16, 2007.
European Search Report EP 06022028.2 dated Feb. 13, 2007.
European Search Report EP 06023756.7 dated Feb. 21, 2008.
European Search Report EP 06024122.1 dated Apr. 16, 2007 .
European Search Report EP 06024123.9 dated Mar. 6, 2007.
European Search Report EP 06025700.3 dated Apr. 12, 2007.
European Search Report EP 07000885.9 dated May 15, 2007.
European Search Report EP 07001480.8 dated Apr. 19, 2007.
European Search Report EP 07001481.6 dated May 2, 200.
European Search Report EP 07001485.7 dated May 23, 2007.
European Search Report EP 07001488.1 dated Jun. 5, 2007.
European Search Report EP 07001489.9 dated Dec. 20, 2007.
European Search Report EP 07001491 dated Jun. 6, 2007.
European Search Report EP 07001527.6 dated May 18, 2007.
European Search Report EP 07007783.9 dated Aug. 14, 2007.
European Search Report EP 07008207.8 dated Sep. 13, 2007.
European Search Report EP 07009026.1 dated Oct. 8, 2007.
European Search Report EP 07009028 dated Jul. 16, 2007.
European Search Report EP 07009029.5 dated Jul. 20, 2007.
European Search Report EP 07009321.6 dated Aug. 28, 2007.
European Search Report EP 07009322.4 dated Jan. 14, 2008.
European Search Report EP 07010672.9 dated Oct. 16, 2007.
European Search Report EP 07010673.7 dated Oct. 5, 2007.
European Search Report EP 07013779.9 dated Oct. 26, 2007.
European Search Report EP 07015191.5 dated Jan. 23, 2007.
European Search Report EP 07015601.3 dated Jan. 4, 2007.
European Search Report EP 07015602.1 dated Dec. 20, 2007.
European Search Report EP 07018375.1 dated Jan. 8, 2008.
European Search Report EP 07018821 dated Jan. 14, 2008.
European Search Report EP 07019173.9 dated Feb. 12, 2008.
European Search Report EP 07019174.7 dated Jan. 29, 2008.
European Search Report EP 07019178.8 dated Feb. 12, 2008.
European Search Report EP 07020283.3 dated Feb. 5, 2008.
European Search Report EP 07253835.8 dated Dec. 20, 2007.
European Search Report EP 08001019 dated Sep. 23, 2008.
European Search Report EP 08004975 dated Jul. 24, 2008.
European Search Report EP 08006731.7 dated Jul. 29, 2008.
European Search Report EP 08006733 dated Jul. 7, 2008.
European Search Report EP 08006734.1 dated Aug. 18, 2008.
European Search Report EP 08006735.8 dated Jan. 8, 2009.
European Search Report EP 08015842 dated Dec. 5, 2008.
European Search Report EP 98300964.8 dated Dec. 13, 2000.
European Search Report EP 98944778 dated Nov. 7, 2000.
European Search Report EP 98958575.7 dated Oct. 29, 2002.
International Search Report PCT/US01/11218 dated Aug. 14, 2001.
International Search Report PCT/US01/11224 dated Nov. 13, 2001.
International Search Report PCT/US01/11340 dated Aug. 16, 2001.
International Search Report PCT/US01/11420 dated Oct. 16, 2001.
International Search Report PCT/US02/01890 dated Jul. 25, 2002.
International Search Report PCT/US02/11100 dated Jul. 16, 2002.
International Search Report PCT/US03/09483 dated Aug. 13, 2003.
International Search Report PCT/US03/22900 dated Dec. 2, 2003.
International Search Report PCT/US03/37110 dated Jul. 25, 2005.
International Search Report PCT/US03/37111 dated Jul. 28, 2004.
International Search Report PCT/US03/37310 dated Aug. 13, 2004.
International Search Report PCT/US04/04685 dated Aug. 27, 2004.
International Search Report PCT/US04/13273 dated Dec. 15, 2004.
International Search Report PCT/US04/15311 dated Jan. 12, 2004.
International Search Report PCT/US98/18640 dated Jan. 29, 1998.
International Search Report PCT/US98/23950 dated Jan. 14, 1998.
International Search Report PCT/US99/24869 dated Feb. 11, 2000.
"Quick Lock Connector", http://www.quicklockforum.org/Resolutions.html; © 2007 ANOISON.
"Common Coaxial Connectors", http://ece-www.colorado.edu/~kuester/Coax/connchart.htm; Edward F. Kuester; Department of Electrical and Computer Engineering; University of Colorado, Sep. 2000.
ODU MEDI-SNAP® Miniature Cylindrical Connectors with Push-Pull-Locking in Plastic; www.idu-usa.com; Catalogue No: 1005ME-b-e; Werr. Sep. 4, 2009.

* cited by examiner

FLOATING CONNECTOR FOR MICROWAVE SURGICAL DEVICE

CROSS-REFERENCE TO RELATED APPLICATIONS

This application claims the benefit of priority to U.S. Provisional Application Ser. No. 60/990,341 entitled "FLOATING CONNECTOR FOR MICROWAVE SURGICAL DEVICES" filed Nov. 27, 2007 by Gene H. Arts et al which is incorporated by reference herein.

BACKGROUND

1. Technical Field

The present disclosure relates generally to microwave surgical devices used in tissue ablation procedures. More particularly, the present disclosure is directed to a floating connector assembly for coupling a microwave ablation antenna to a microwave generator.

2. Background of Related Art

Microwave ablation of biological tissue is a well-known surgical technique used routinely in the treatment of certain diseases which require destruction of malignant tumors or other necrotic lesions. Typically, microwave surgical apparatus used for ablation procedures includes a microwave generator which functions as a source of surgical radiofrequency energy, and a microwave surgical instrument having a microwave antenna for directing the radiofrequency energy to the operative site. Additionally, the instrument and generator are operatively coupled by a cable having a plurality of conductors for transmitting the microwave energy from the generator to the instrument, and for communicating control, feedback and identification signals between the instrument and the generator. The cable assembly may also include one or more conduits for transferring fluids.

Commonly, the microwave instrument and the cable are integrated into a single unit wherein the cable extends from the proximal end of the instrument and terminates at a multi-contact plug connector, which mates with a corresponding receptacle connector at the generator. Separate contact configurations are typically included within the multi-contact connector to accommodate the different electrical properties of microwave and non-microwave signals. Specifically, coaxial contacts are used to couple the microwave signal, while non-coaxial contacts in a circular or other arrangement are used to couple the remaining signals and/or fluids. Suitable coaxial and non-coaxial connectors are commercially available "off the shelf" that can be used side-by-side within a single housing in the construction of a cost-effective multi-contact connector for microwave ablation systems.

The use of two disparate connectors within a single housing may have drawbacks. Specifically, the coaxial and non-coaxial connectors assembled within the cable-end plug must be precisely aligned with their mating connectors on the microwave generator receptacle to avoid interference or binding when coupling or uncoupling the connectors. The need for such precise alignment dictates the connectors be manufactured to very high tolerances, which, in turn, increases manufacturing costs and reduces production yields. This is particularly undesirable with respect to the microwave surgical instrument, which is typically discarded after a single use and thus subject to price pressure.

SUMMARY

The present disclosure provides a floating connector apparatus having at least two connectors, such as a coaxial and a non-coaxial connector, within a single supporting housing. At least one of the connectors is floatably mounted to the housing. By using a floating rather than a rigid mounting, the floating connector is afforded a range of movement sufficient to compensate for spacing variations between and among the corresponding mating connectors. In this manner, commonly-available connectors can be used in a single supporting housing without requiring exacting manufacturing tolerances and the associated costs thereof.

In one embodiment, a plug (i.e., male) housing and a corresponding mating receptacle (i.e., female) housing are provided. The male housing includes a fixedly inputted male coaxial connector, such as a QN connector, that is mounted in spaced relation relative to a fixedly mounted male circular connector, such as an Odu™ Medi-Snap™ connector. The counterpart female housing includes a female coaxial connector that is fixedly mounted to the receptacle housing in spaced relation relative to a female circular connector that is floatably mounted to the receptacle housing. The floating female circular connector has at least one degree of freedom of movement, for example, the floatably mounted connector can move along the X-axis (i.e. left-right); the Y-axis (up-down); the Z-axis (in-out); or it can rotate, pitch, or yaw about the longitudinal axis of the circular connector, or any combination thereof. A positive stop can be included for limiting inward movement of the floating connector along its Z-axis to enable sufficient coupling force to be generated when mating the connectors. When the plug and receptacle are coupled, the floatably mounted connector is able to adjust to spacing and angular variations between it and the fixed connectors. This eliminates binding and interference among the connectors, establishes and maintains electrical continuity, provides tactile feedback to the user, and permits multiple connectors to be included within a single housing without the expense of precision manufacturing and high production tolerances.

According to another embodiment, the floating connector is mounted to a plate-like mounting assembly that includes a stationary rim concentrically disposed around a suspended inner member. The stationary rim is rigidly coupled to, or is integral to, the receptacle housing. The connector is rigidly coupled to the suspended inner member. The stationary rim and suspended inner member are resiliently coupled along the substantially annular interstice between the rim and the member. It is contemplated the interstitial edges of the stationary rim and suspended inner member can abut or overlap. The resilient coupling can include one or more elastomeric materials or springs as further described herein. In an embodiment, the resilient coupling can be a captured o-ring. The floating connector may include a floating member having a connector fixedly disposed therethrough, the connector including a mating end adapted to couple to a mating connector and a mounting end which mounts to the floating member. The floating connector may further include a support member having an opening defined therein, the opening including an internal dimension greater than the mounting end of the connector to define a clearance between the opening and the mounting end of the connector, the floating member and the connector being positioned in substantial concentric alignment with the opening. The floating connector also includes an elastomeric coupling fixedly disposed between the floating member and the support member.

According to a further embodiment of the present disclosure, the floating connector assembly may include a resilient spring mounting plate, which further includes an outer stationary rim and suspended inner member that are coupled by at least one thin resilient beam. The beam is attached at one end to the stationary rim and at the other end to the suspended inner member. The rim, the member and the resilient beams can be a single piece formed by, for example, stamping, injection molding, laser cutting, water jet machining, chemical machining, blanking, fine blanking, compression molding, or extrusion with secondary machining. The spring plate can include at least one slot defining a floating region concentrically disposed within a fixed region, the slots further defining the spring beam. The spring beam couples the floating region and the fixed region. The spring plate further includes a connector fixedly disposed therethrough. The connector includes a mating end adapted to couple to a mating connector and a mounting end which mounts to the floating region of the spring plate.

The mounting assembly may include a support member having an opening defined therein, the opening including an internal dimension greater than the mounting end of the connector to define a clearance between the opening and the mounting end of the connector, the spring plate and the connector being positioned in substantial concentric alignment with the opening. The floating connector includes a collar for securing the spring plate to the support member, the collar further including an aperture defined therein having an internal dimension greater than the mating end of the connector to define a second clearance between the aperture and the mating end of the connector, and at least one coupling device which attaches the collar and the spring plate to the support member.

BRIEF DESCRIPTION OF THE DRAWINGS

The above and other aspects, features, and advantages of the present disclosure will become more apparent in light of the following detailed description when taken in conjunction with the accompanying drawings in which.

DETAILED DESCRIPTION

Particular embodiments of the present disclosure will be described herein with reference to the accompanying drawings. In the following description, well-known functions or constructions are not described in detail to avoid obscuring the present disclosure with unnecessary detail. References to connector gender presented herein are for illustrative purposes only, and embodiments are envisioned wherein the various components described can be any of male, female, hermaphroditic, or sexless gender. Likewise, references to circular and coaxial connectors are illustrative in nature, and other connector types, shapes and configurations are contemplated within the present disclosure.

Figure 1:
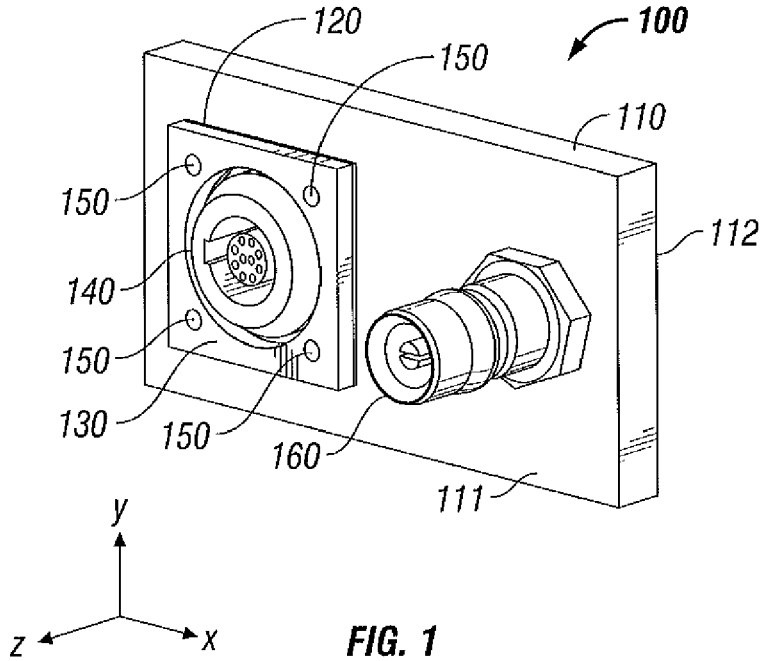
FIG. 1 is an oblique view of an embodiment of a floating connector in accordance with the present disclosure.

Referring to FIG. 1, there is disclosed a floating connector assembly 100 that includes support member 110 having an outer surface 111 and an inner surface 112. Support member 110 further includes a coaxial connector 160 fixedly mounted thereto in spaced relation relative to floating connector 120. Floating connector 120 is fixedly mounted to support member 110 by a coupling device 150, as will be described in detail below. Coaxial connector 160 may be mounted to support member 110 by any suitable means such as by a nut or a clip (not shown) as is well-known in the art. The spaced relationship of floating connector 120 to coaxial connector 160 substantially mirrors the spaced relationship of a corresponding mating connector assembly 790, shown by example in FIGS. 10A-C, wherein male circular connector 780 is configured to matingly engage female circular connector 740 and coaxial connector 785 is configured to matingly engage coaxial connector 760.

Figure 2:
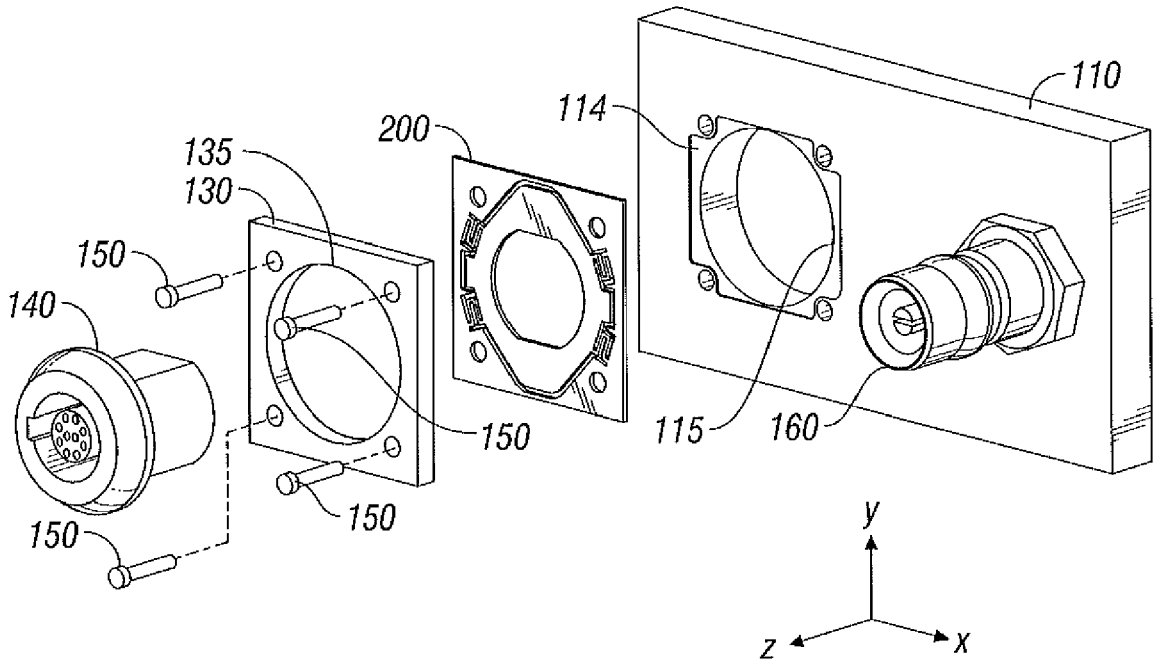
FIG. 2 is an exploded view of an embodiment of the floating connector of FIG. 1 having a resilient mounting plate, circular connector, and coaxial connector.

With reference to FIG. 2, floating connector 120 includes a collar 130 and a female circular connector 140 which is configured to floatably mount within floating connector 120 as will be further described herein. Female circular connector 140 can be of a keyed type such as an Odu™ or LEMO™ connector as will be familiar to the skilled artisan. Support member 110 and collar 130 further include openings 115 and 135, defined therein respectively, dimensioned to permit floating movement of and accommodate electrical and/or fluidic connections to, female circular connector 140.

Figure 3:
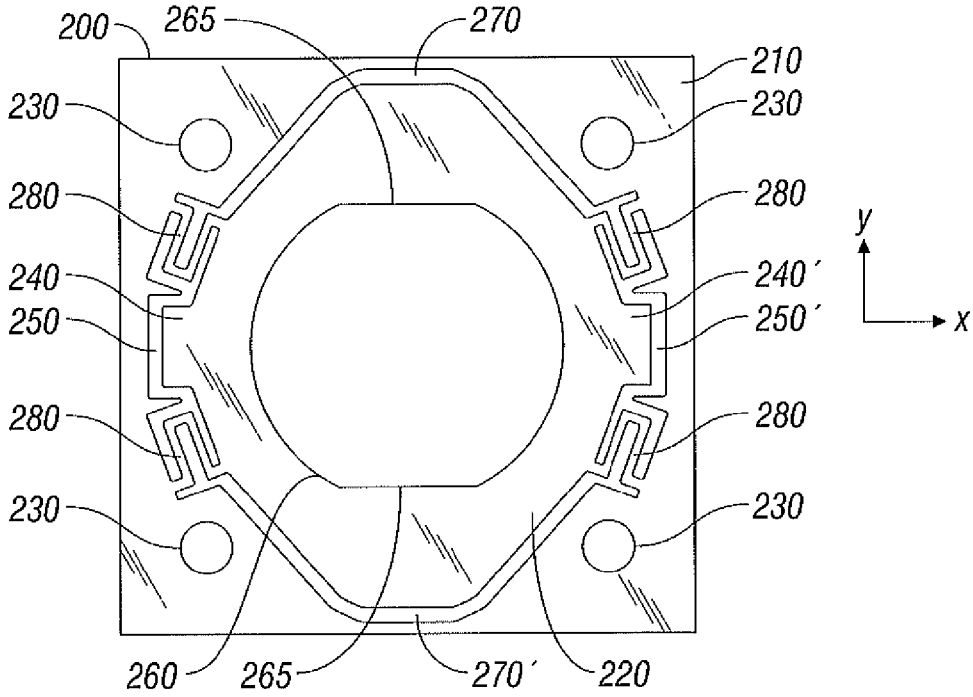
FIG. 3 is an enlarged view of the resilient spring mounting plate of FIG. 2.

Floating connector 120 further includes a spring plate 200 having an arrangement of slots 250, 250', 270, 270' defined thereon which, in turn, are arranged to define a fixed region 210 and a floating region 220 having spring beams 280 disposed therebetween (see FIG. 3). Spring plate 200 can be constructed of any material having spring-like properties, such a spring steel or a resilient polymer, and can be formed by any suitable means, such as stamping, injection molding, laser machining, water jet machining, or chemical machining. A recess 114 is disposed upon outer surface 111 and located around the perimeter of opening 115, and is dimensioned to provide floating movement of spring plate 200 sufficient to enable proper coupling of connector 140 with a mating connector. As can be readily appreciated, recess 114 also prevents excessive inward movement of spring plate 200 to enable sufficient mating forces to be generated during coupling, and also to prevent exceeding the elastic limits of spring plate 200.

Figure 5A:
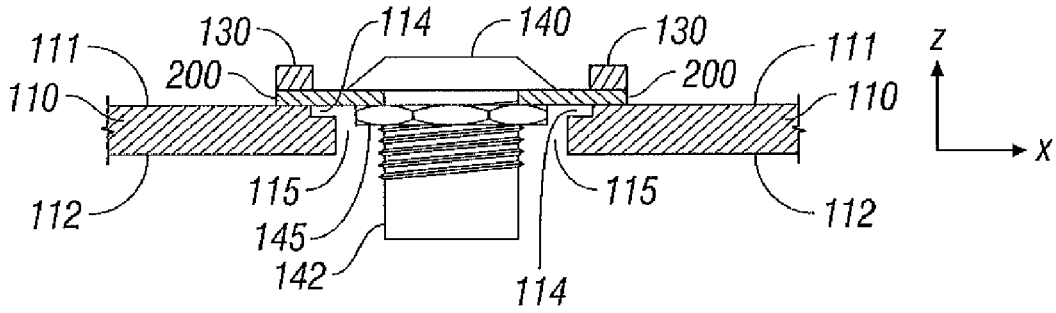
FIG. 5A is a side cross sectional view of one embodiment of the floating connector in accordance with the present disclosure.
Figure 5B:
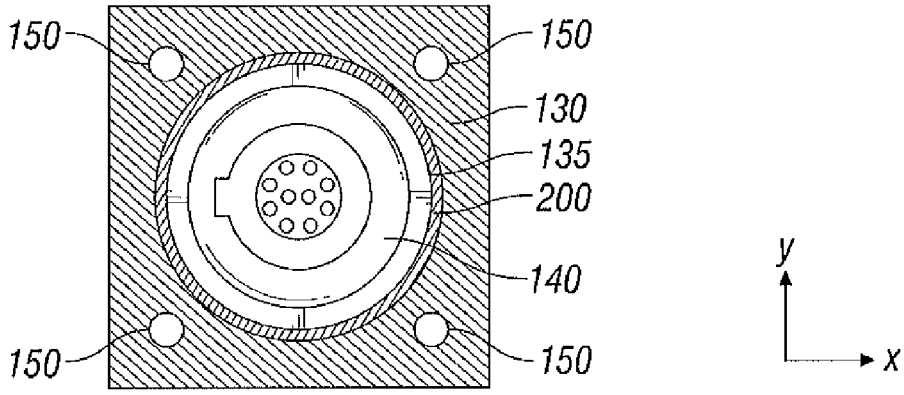
FIG. 5B is a top view of one embodiment of the floating connector in accordance with the present disclosure.

As best seen in FIG. 3, floating region 220 further includes a centrally disposed mounting hole 260 defined therein dimensioned to receive a mounting boss 142 of female circular connector 140. In one embodiment, mounting hole 260 is substantially circular and includes opposing flat areas 265 dimensioned to accept mounting boss 142 having corresponding opposing flat areas (not shown) to inhibit unintended rotation of female circular connector 140 within mounting hole 260, as is well-known in the art. Female circular connector 140 can be retained to spring plate 200 by a nut 145, as shown in FIGS. 5A and 5B, or may be retained by any suitable means such as integral clip, external clip, or adhesive. Slots 250, 250' further describe stops 240, 240' for limiting the range of motion of floating member 220 along the X-axis, the Y-axis, the Z-axis, and/or rotationally about the Z-axis (i.e. longitudinal axis) of female circular connector 140.

Figure 4:
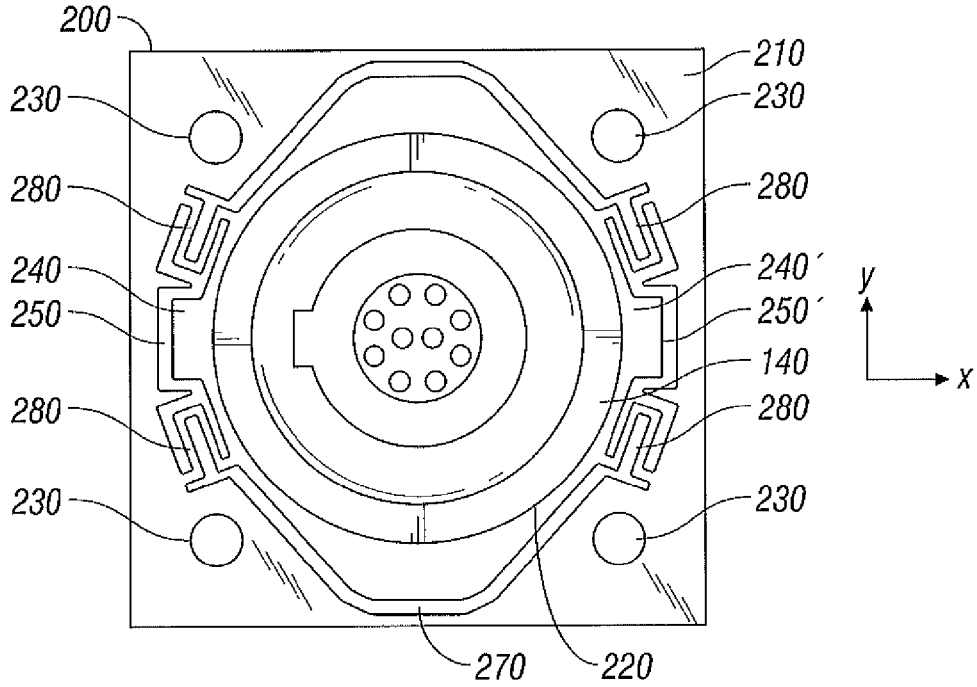
FIG. 4 is an enlarged view of a circular connector mounted atop the resilient spring mounting plate of FIG. 3.

With reference now to FIGS. 4, 5A, and 5B, female circular connector 140 of spring plate 200 is sandwiched between collar 130 and support member 110 in substantial coaxial alignment with opening 115 and opening 135. Collar 130 and spring plate 200 are affixed to support member 110 by a coupling devices 150 which can be threaded fasteners, rivets, adhesive, bonding, or other suitable coupling devices. By this configuration, spring beams 280 and/or the overall resilient properties of spring plate 200 afford circular connector 140 a range of movement within openings 115 and 135 and recess 114, for example, along the X-axis (left-right), the Y-axis (up-down), the Z-axis (in-out), and/or rotationally about the Z-axis (roll).

Figures 10A, 10B, 10C:
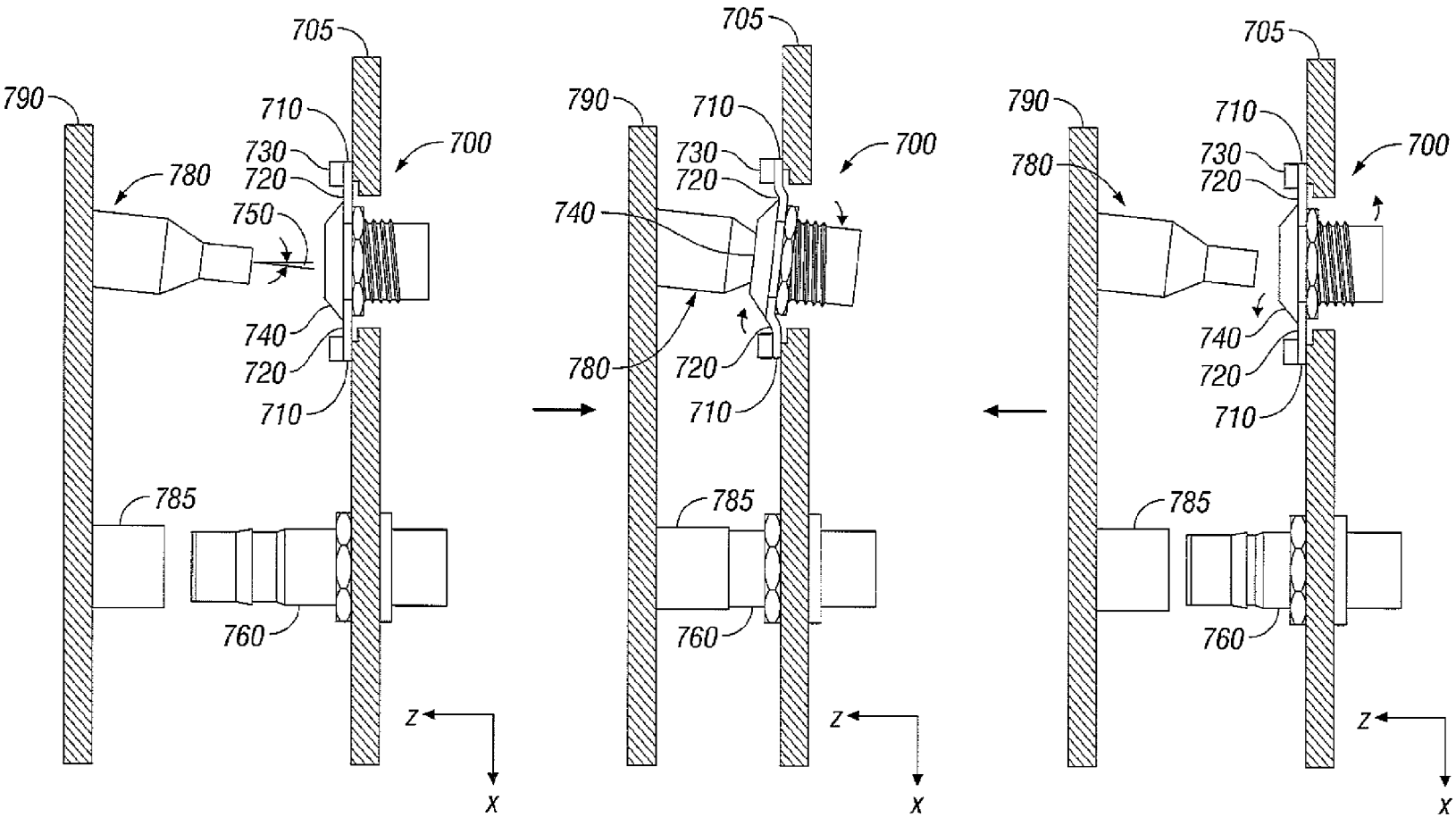
FIGS. 10A-10C are side views illustrating the coupling and uncoupling of the floating connector with a connector assembly.

By way of example, FIGS. 10A-10C show a schematic illustration of the coupling and uncoupling of the connector assembly with floating connector assembly 700. In particular, FIG. 10A shows male circular connector 780 poised to mate with female circular connector 740, wherein the longitudinal axis of male circular connector 780 is misaligned by an illustrative angle 750 with respect to longitudinal axis Z of circular connector 740. In FIG. 10B, as the connector assemblies are joined, coaxial connectors 785 and 760, which are fixed to their respective support members, couple normally, while male circular connector 780, which is imprecisely aligned with circular connector 740, causes spring beams 720 (see FIG. 3) and/or spring plate 710 to deflect in response to the coupling forces applied by male circular connector 780 to circular connector 740. This permits female circular connector 740 to move into substantial alignment with male circular connector 780 as the connectors are brought into a fully-coupled state. In this manner, the desired coupling of two connectors 740 and 780, which were originally misaligned, is achieved without the interference or binding which would normally be encountered with such initial misalignment and/or imprecise alignment. Turning now to FIG. 10C, as the connector assemblies are decoupled, male circular connector 780 parts from circular connector 740, enabling spring beams 720 and/or the overall resilient properties of spring plate 710 to bias circular connector 740 back to its original position, i.e., into substantially orthogonal alignment with support member 705.

Figure 6A:
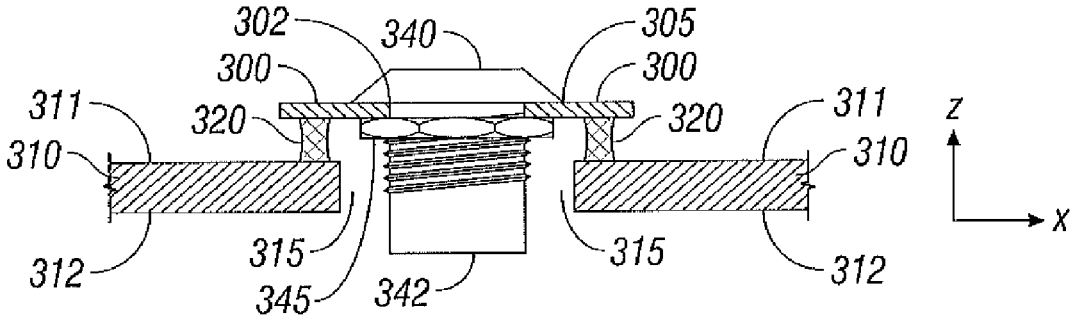
FIG. 6A is a side cross sectional view of another embodiment of the floating connector in accordance with the present disclosure showing a floating member resiliently coupled to a support member in a substantially overlapping configuration.
Figure 6B:
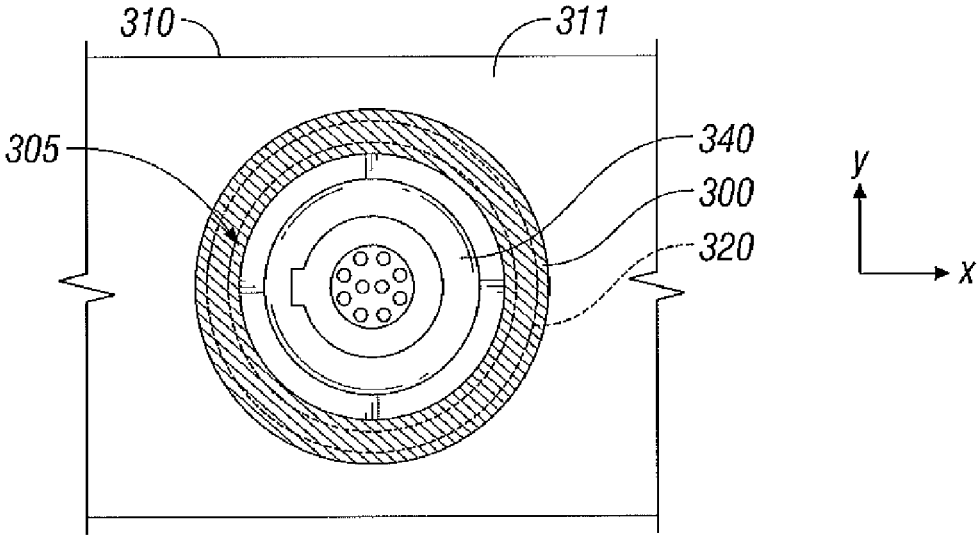
FIG. 6B is a top view of the embodiment of the floating connector shown in FIG. 6A in accordance with the present disclosure.

Other embodiments contemplated by the present disclosure are shown with reference to FIG. 6A-FIG. 9. FIGS. 6A and 6B show one embodiment of a floating connector having a floating assembly 305 which includes a female circular connector 340 that is fixedly mounted to a floating member 300 though an opening 302 provided therein. The opening 302 is dimensioned to accept a mounting boss 342 of circular connector 340 as previously described herein. Floating member 300 is concentrically aligned with an opening 315 defined in a support member 310, and is further dimensioned to extend at the perimeter thereof beyond the edge of opening 315. An elastomeric coupling 320 is adhesively disposed between floating member 300 and support member 310 along the perimetric interstice defined by the overlap therebetween. Elastomeric coupling 320 may be formed from any suitable resilient material, such as rubber, neoprene, nitrite, silicone, foam rubber, or polyurethane foam. Additionally or optionally, elastomeric coupling 320 can include bellows-like corrugations to alter the resilient properties thereof.

Figure 7A:
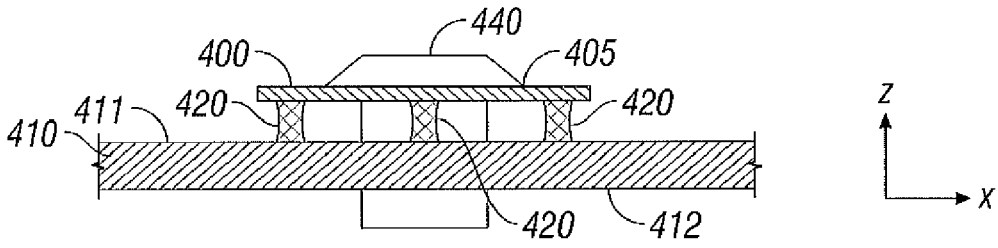
FIG. 7A is a side view of still another embodiment of the floating connector in accordance with the present disclosure showing a floating member resiliently coupled to a support member and configured to limit movement to a single axis of motion.
Figure 7B:
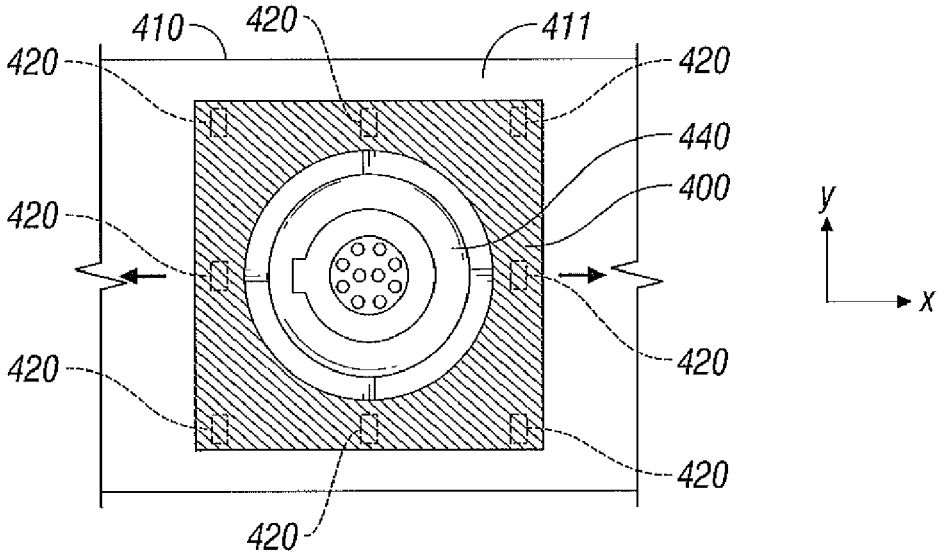
FIG. 7B is a top view of the embodiment of the floating connector shown in FIG. 7A in accordance with the present disclosure.

FIGS. 7A and 7B show another embodiment of a floating connector in accordance with the present disclosure wherein the motion of a floating assembly 405 is substantially limited to a single axis of motion. A plurality of bar-shaped elastomeric couplings 420 are adhesively disposed between a floating member 400 and a support member 410, and are arranged in mutually parallel configuration and generally orthogonal to the desired axis of motion. The range of motion of floating assembly 405 is dictated by the shape and arrangement of at least one bar-shaped coupling 420. Other embodiments are envisioned which include, for example, elastomeric couplings of other shapes and arrangements, including without limitation square-shaped or dot-shaped elastomeric couplings in a lattice arrangement.

Figure 8A:
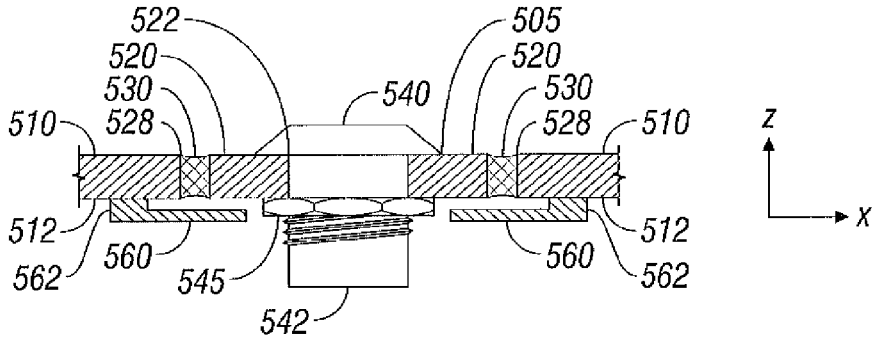
FIG. 8A is a side view of yet another embodiment of the floating connector in accordance with the present disclosure showing a floating member and support member in a substantially abutting configuration having a positive stop member.
Figure 8B:
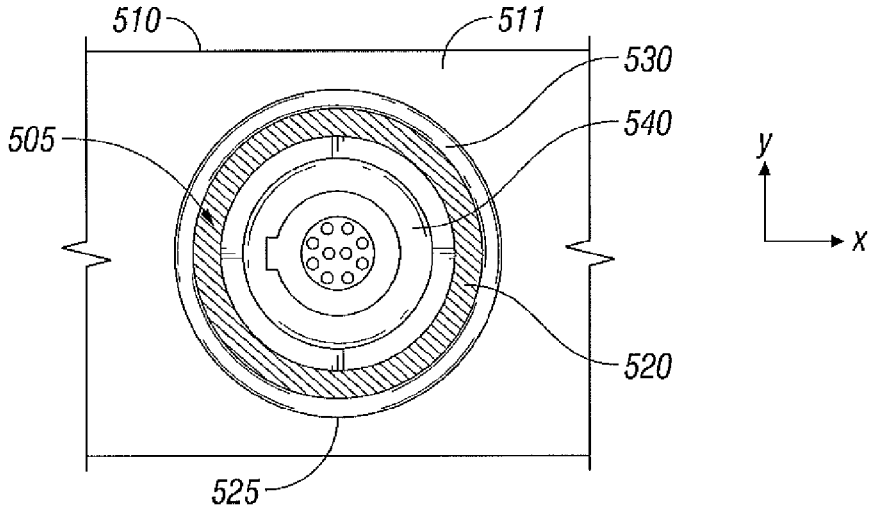
FIG. 8B is a top view of the embodiment of the floating connector shown in FIG. 8A in accordance with the present disclosure.
Figure 8C:
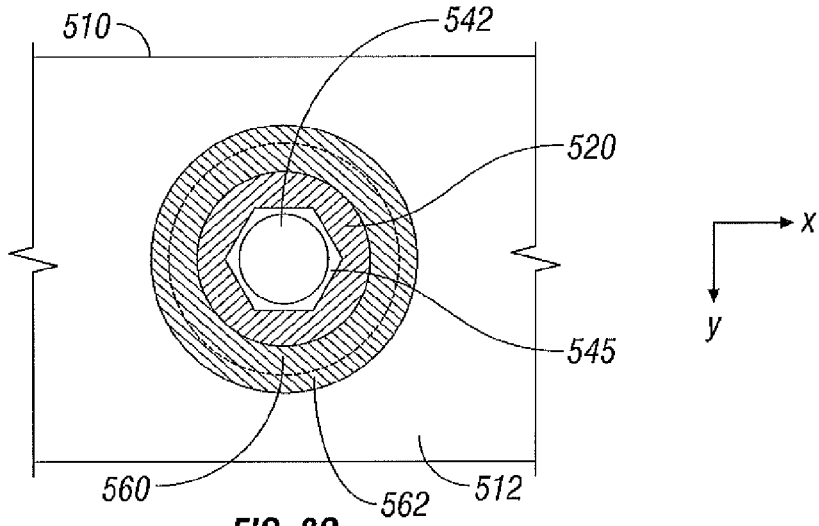
FIG. 8C is a bottom view of the embodiment of the floating connector shown in FIG. 8A in accordance with the present disclosure.

Turning now to FIGS. 8A, 8B, and 8C, another embodiment in accordance with the present disclosure is provided wherein a floating member 520 is concentrically disposed within an opening 525 defined in a support member 510, the opening having a stationary rim 528 that is rigidly coupled to, or is integral to, support member 510. A floating assembly 505 includes a connector 540 that is rigidly coupled to the floating member 520. Stationary rim 528 and floating member 520 are resiliently coupled along their annular interstice by an elastomeric coupling 530 that is adhesively disposed between stationary rim 528 and floating member 520. The overall resilient properties of elastomeric coupling 530 afford floating assembly 505, and particularly, circular connector 540, a range of movement to permit coupling with a misaligned mating connector, such as connector 780, as previously described herein. Optionally, a positive stop 560 is included for limiting the inward excursion of floating assembly 505 along the Z-axis during coupling to allow sufficient mating force to be generated when coupling the connectors 540 with, for example, connector 780. In one embodiment, positive stop 560 has an annular shape and is fixedly disposed in concentric relation to floating assembly 505 at an inner surface 512 of support member 510 along the perimeter of opening 525. Positive stop 560 can also include a standoff 562 which can be formed integrally with positive stop 560 for dictating the maximum inward displacement of floating assembly 505.

Figure 9:
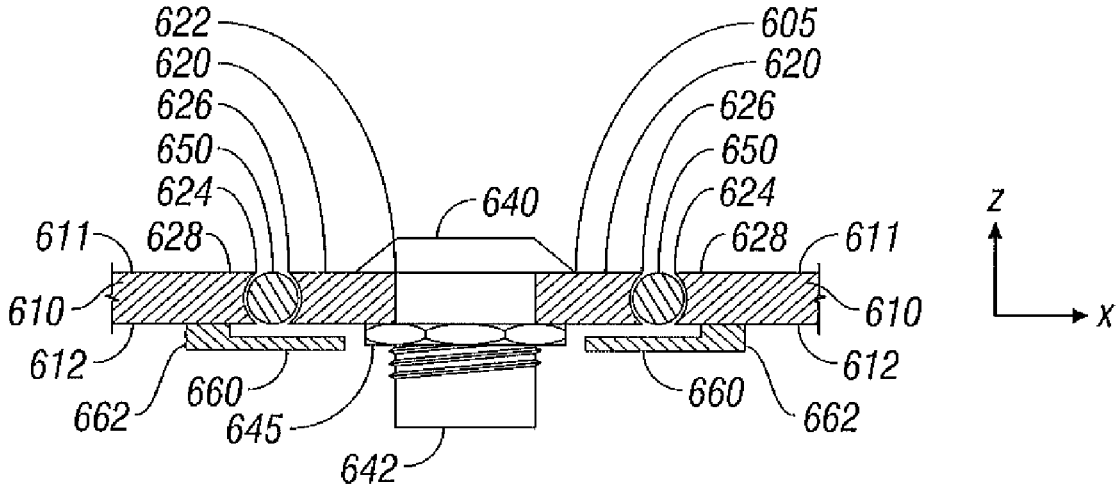
FIG. 9 is a side view of still another embodiment of the floating connector in accordance with the present disclosure showing a floating member resiliently coupled to a support member by a captured o-ring, and having a positive stop member.

In another embodiment as illustrated in FIG. 9, a stationary rim 628 and a floating member 620 are joined along their annular interstice by a captured o-ring 650. A floating assembly 605 includes a connector 640 that is rigidly coupled to the floating member 620. The captured o-ring 650 may be formed from any suitable resilient material, such as rubber, neoprene, nitrile, or silicone, and is compressively retained within opposing semicircular saddles 624 and 626 formed in the circumferential edges of opening 625 and floating member 620, respectively. Upon coupling, the captured o-ring 650 can deform and/or partially roll in response to the mating forces applied to connector 640, and in this manner, permit connector 640 to move into substantial alignment a misaligned mating connector, for example, connector 780, as the connectors are brought into a fully-coupled state.

The described embodiments of the present disclosure are intended to be illustrative rather than restrictive, and are not intended to represent every embodiment of the present disclosure. Further variations of the above-disclosed embodiments and other features and functions, or alternatives thereof, may be made or desirably combined into many other different systems or applications without departing from the spirit or scope of the disclosure as set forth in the following claims both literally and in equivalents recognized in law.

What is claimed is:

1. A floating connector, comprising:

a spring plate having at least one slot defining a floating region concentrically disposed within a fixed region, the at least one slot further defining at least one spring beam coupling the floating region and the fixed region, the spring plate further having a connector fixedly disposed therethrough, the connector having a mating end adapted to couple to a mating connector and a mounting end which mounts to the floating region;

a support member having an opening defined therein, the opening including an internal dimension greater than the mounting end of the connector to define a clearance between the opening and the mounting end of the connector, the spring plate and the connector being positioned in substantial concentric alignment with the opening;

a collar for securing the spring plate to the support member, the collar further including an aperture defined therein having an internal dimension greater than the mating end of the connector to define a second clearance between the aperture and the mating end of the connector; and at least one coupling device which attaches the collar and the spring plate to the support member.

2. The floating connector according to claim 1, wherein the at least one slot further defines at least one stop for limiting the range of motion of the floating region.

3. The floating connector according to claim 1, wherein the at least one slot is formed by a process selected from a group consisting of stamping, machining, injection molding, laser machining, water jet machining, chemical machining, blanking, fine blanking, compression molding, and extrusion with secondary machining.

4. The floating connector according to claim 1, wherein the coupling device which attaches the collar and the spring plate to the support member is selected from a group consisting of at least one threaded fastener, at least one rivet, adhesive and welding.

5. The floating connector according to claim 1, wherein the connector is a keyed circular connector.

6. The floating connector according to claim 1, wherein the connector is an electrical connector.

7. The floating connector according to claim 1, wherein the connector is a fluidic connector.

8. The floating connector according to claim 1, further comprising at least one additional connector mounted to the support member in spaced relation to the connector.

9. The floating connector according to claim 1, wherein the at least one additional connector is a coaxial connector.

10. The floating connector according to claim 1, wherein the at least additional connector is fixedly mounted to the support member.

11. The floating connector according to claim 1, wherein the at least one additional connector is floatably mounted to the support member.

* * * * *